US010919755B2

(12) United States Patent
Takahashi et al.

(10) Patent No.: US 10,919,755 B2
(45) Date of Patent: Feb. 16, 2021

(54) BEVERAGE DISCHARGE COCK, VALVE ROD, AND BEVERAGE DISPENSER

(71) Applicants: ASAHI GROUP HOLDINGS, LTD., Tokyo (JP); ASAHI BREWERIES, LTD., Tokyo (JP)

(72) Inventors: Tomohiro Takahashi, Moriya (JP); Yasuhiro Kurabe, Moriya (JP); Hirofumi Imai, Kanagawa (JP); Kazuya Shiraishi, Kanagawa (JP)

(73) Assignee: ASAHI GROUP HOLDINGS, LTD., Tokyo (JP)

( * ) Notice: Subject to any disclaimer, the term of this patent is extended or adjusted under 35 U.S.C. 154(b) by 0 days.

(21) Appl. No.: 16/435,598

(22) Filed: Jun. 10, 2019

(65) Prior Publication Data

US 2019/0292039 A1 Sep. 26, 2019

Related U.S. Application Data

(63) Continuation of application No. PCT/JP2016/087038, filed on Dec. 13, 2016.

(51) Int. Cl.
*B67D 3/04* (2006.01)
*B67D 1/04* (2006.01)

(52) U.S. Cl.
CPC ..... *B67D 3/04* (2013.01); *B67D 1/04* (2013.01)

(58) Field of Classification Search
CPC ..... B67D 1/145; B67D 1/127; B67D 1/1275; B67D 1/1411; B67D 1/1438; B67D 3/04;
(Continued)

(56) References Cited

U.S. PATENT DOCUMENTS 2,416,581 A * 2/1947 Harr ..... B67D 1/0082 137/894
2003/0006254 A1* 1/2003 Itou ..... B67D 1/145 222/518

FOREIGN PATENT DOCUMENTS

FR 2593878 A1 8/1987
JP H09-002590 A 1/1997
(Continued)

OTHER PUBLICATIONS

Extended European Search Report for European Patent Application No. 16924113.0 dated Jul. 2, 2020.
(Continued)

*Primary Examiner* — J C Jacyna
(74) *Attorney, Agent, or Firm* — Thomas | Horstemeyer, LLP

(57) ABSTRACT

A beverage discharge cock to which beverage is supplied from a beverage supply source, comprising: a valve main body including a hole and a valve seat arranged in an end portion of the hole; a valve rod slidably arranged in the hole, and including a valve body that forms a first valve together with the valve seat of the valve main body, and a first seal; and a movable part slidably arranged in the hole, and including a second seal facing the first seal, the second seal forming a second valve together with the first seal of the valve rod, wherein the valve rod includes a first channel extending through the valve body, and one or a plurality of second channels extending from the first seal to the first channel, and the second channel includes a first portion, and a second portion arranged between the first seal and the first portion, and a diameter of the second portion is smaller than a diameter of the first portion.

23 Claims, 8 Drawing Sheets

(58) Field of Classification Search
CPC ..... B67D 3/043; B67D 3/044; B67D 3/045; B67D 3/046
See application file for complete search history.

(56) References Cited

FOREIGN PATENT DOCUMENTS

| | | | | |
|---|---|---|---|---|
| JP | 2002-332096 | A | 11/2002 | |
| JP | 2004-175413 | A | 6/2004 | |
| JP | 2006-206157 | A | 8/2006 | |
| JP | 2013-199284 | A | 10/2013 | |
| JP | 2016-179861 | A | 10/2016 | |
| KR | 101413093 | B1 | 7/2014 | |
| RU | 2364568 | C1 | 8/2009 | |
| WO | 2018/109834 | A1 | 6/2018 | |
| WO | WO 2018/109834 | * | 6/2018 | ..... B67D 3/04 |

OTHER PUBLICATIONS

International Search Report for PCT/JP2016/087038 dated Feb. 28, 2017 (partially translated).
Notice of Allowance for Russian Patent Application No. 2019120522 dated Dec. 12, 2019 (partially translated).

* cited by examiner

FIG. 7

| L2 | φ2 | NUMBER OF SECOND CHANNELS | FOAM DENSITY RATIO |
|---|---|---|---|
| 2.5 | 0.5 | 1 | 119% |
| | 0.7 | 1 | 130% |
| | | 2 | 138% |
| 1.7 | 0.5 | 2 | 108% |
| | 0.6 | | 113% |
| | 0.7 | | 119% |
| | 0.8 | | 112% |
| 1.5 | 0.5 | 2 | 115% |
| | 0.6 | | 125% |
| | 0.7 | | 139% |
| | 0.8 | | 137% |
| 1.0 | 0.5 | 2 | 115% |
| | 0.6 | | 143% |
| | 0.7 | | 157% |
| | 0.8 | | 142% |
| 0.7 | 0.7 | 1 | 102% |
| | | 2 | 155% |
| | | 3 | 122% |
| | | 4 | 110% |
| 0.5 | 0.5 | 2 | 107% |
| | 0.6 | | 145% |
| | 0.7 | | 156% |
| | 0.8 | | 138% |

BEVERAGE DISCHARGE COCK, VALVE ROD, AND BEVERAGE DISPENSER

CROSS-REFERENCE TO RELATED APPLICATION

This application is a continuation of International Patent Application No. PCT/JP2016/087038 filed on Dec. 13, 2016, the entire disclosures of which is incorporated herein by reference.

TECHNICAL FIELD

The present invention relates to a beverage discharge cock, a valve rod, and a beverage dispenser.

BACKGROUND ART

When discharging a carbonated beverage such as beer, it is important to form fine creamy foam. PTL 1 describes a method of decreasing the diameter of a foaming hole, without decreasing the flow rate of beer flowing through a channel hole, by forming a plurality of foaming holes in a valve rod, thereby forming fine creamy foam.

CITATION LIST

Patent Literature

PTL 1: Japanese Patent Laid-Open No. 9-2590

SUMMARY OF INVENTION

Technical Problem

It is understood that the basic concept of the invention described in PTL 1 is to make the diameter of the foaming hole as small as possible, and increase the number of foaming holes in order to suppress a decrease in flow rate of beer flowing through the channel hole caused by the decrease in diameter.

The present inventors conducted an experiment by expecting that the foam density increases when the diameter of the foaming hole is decreased, but the foaming density did not increase even when the diameter of the foaming hole was decreased. More specifically, the present inventors decreased the diameter of the foaming hole to 1.2 mm, 1.0 mm, 0.7 mm, and 0.5 mm, and evaluated a change in foam density. However, no significant effect was found on an increase in foam density resulting from a decrease in diameter of the foaming hole. In addition, the foam density obtained when the diameter of the foaming hole was 0.5 mm, that is, the smallest diameter among the evaluation targets, was lower than the foaming density obtained when the diameter of the foaming hole was 1.2 mm or 1.0 mm. The foam density was evaluated by imaging foam collected by a vessel by using a microscope, cutting out a 1-mm square region from the obtained image, and counting bubbles in the region.

It is an object of the present invention to provide a beverage discharge cock, a valve rod, and a beverage dispenser advantageous in forming fine creamy foam.

Solution to Problem

The first aspect of the present invention is a beverage discharge cock to which beverage is supplied from a beverage supply source, and the beverage discharge cock includes a valve main body including a hole and a valve seat arranged in an end portion of the hole, a valve rod slidably arranged in the hole, and including a valve body that forms a first valve together with the valve seat of the valve main body, and a first seal, and a movable part slidably arranged in the hole, and including a second seal facing the first seal, the second seal forming a second valve together with the first seal of the valve rod, wherein the valve rod includes a first channel extending through the valve body, and one or a plurality of second channels extending from the first seal to the first channel, and the second channel includes a first portion, and a second portion arranged between the first seal and the first portion, and a diameter of the second portion is smaller than a diameter of the first portion.

The second aspect of the present invention is a valve rod to be incorporated into a beverage discharge cock to which beverage is supplied from a beverage supply source, wherein the valve rod includes a valve body and a seal, the valve rod includes a first channel extending through the valve body, and one or a plurality of second channels extending from the seal to the first channel, and the second channel includes a first portion, and a second portion arranged between the first seal and the first portion, and a diameter of the second portion is smaller than a diameter of the first portion.

The third aspect of the present invention is a beverage dispenser, the beverage dispenser includes a beverage discharge cock to which beverage is supplied from a beverage supply source, the beverage discharge cock includes a valve main body including a hole and a valve seat arranged in an end portion of the hole, a valve rod slidably arranged in the hole, and including a valve body that forms a first valve together with the valve seat of the valve main body, and a first seal, and a movable part slidably arranged in the hole, and including a second seal facing the first seal, the second seal forming a second valve together with the first seal of the valve rod, the valve rod includes a first channel extending through the valve body, and one or a plurality of second channels extending from the first seal to the first channel, and the second channel includes a first portion, and a second portion arranged between the first seal and the first portion, and a diameter of the second portion is smaller than a diameter of the first portion. The beverage dispenser can also include a cooling unit for cooling a beverage.

Advantageous Effects of Invention

The present invention provides the beverage discharge cock, the valve rod, and the beverage dispenser advantageous in forming fine creamy foam.

BRIEF DESCRIPTION OF DRAWINGS

FIG. 7 is a view showing evaluation results; and

DESCRIPTION OF EMBODIMENTS

A preferred embodiment of the present invention will be explained below with reference to the accompanying drawings.

Figure 8:
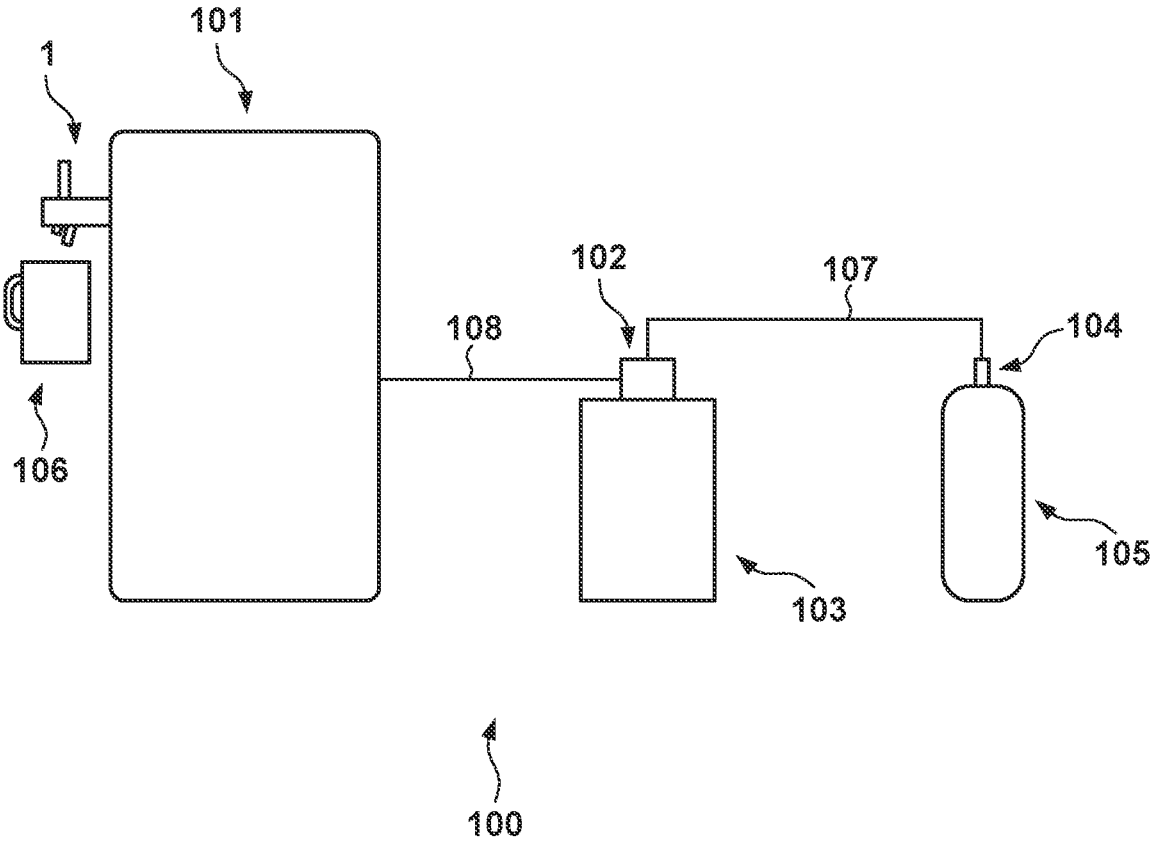
FIG. 8 is a view showing an outline of the arrangement of a beverage discharge apparatus.

FIG. 8 shows a beverage discharge apparatus 100 of the preferred embodiment of the present invention. The beverage discharge apparatus 100 includes a beverage dispenser 101, a supply head 102, and a pressure regulator 104. The pressure regulator 104 is attached to a valve of a carbon dioxide cylinder 105. The pressure regulator 104 reduces the pressure of carbon dioxide supplied from the carbon dioxide cylinder 105, and supplies the carbon dioxide to the supply head 102 through a hose 107. The supply head 102 is attached to a valve of a beverage transport vessel (for example, a barrel) 103 as a beverage supply source. The supply head 102 supplies a beverage such as beer in the beverage transport vessel 103 to the beverage dispenser 101 through a hose 108 by pushing the beverage by the pressure of the carbon dioxide. The beverage dispenser 101 has a beverage discharge cock 1. The beverage dispenser 101 causes a cooling unit to cool the beverage supplied from the beverage transport vessel 103 via the supply head 102 and the hose 108, and discharges the beverage into a beverage providing vessel 106 such as a beer mug through the beverage discharge cock 1.

Figure 1:
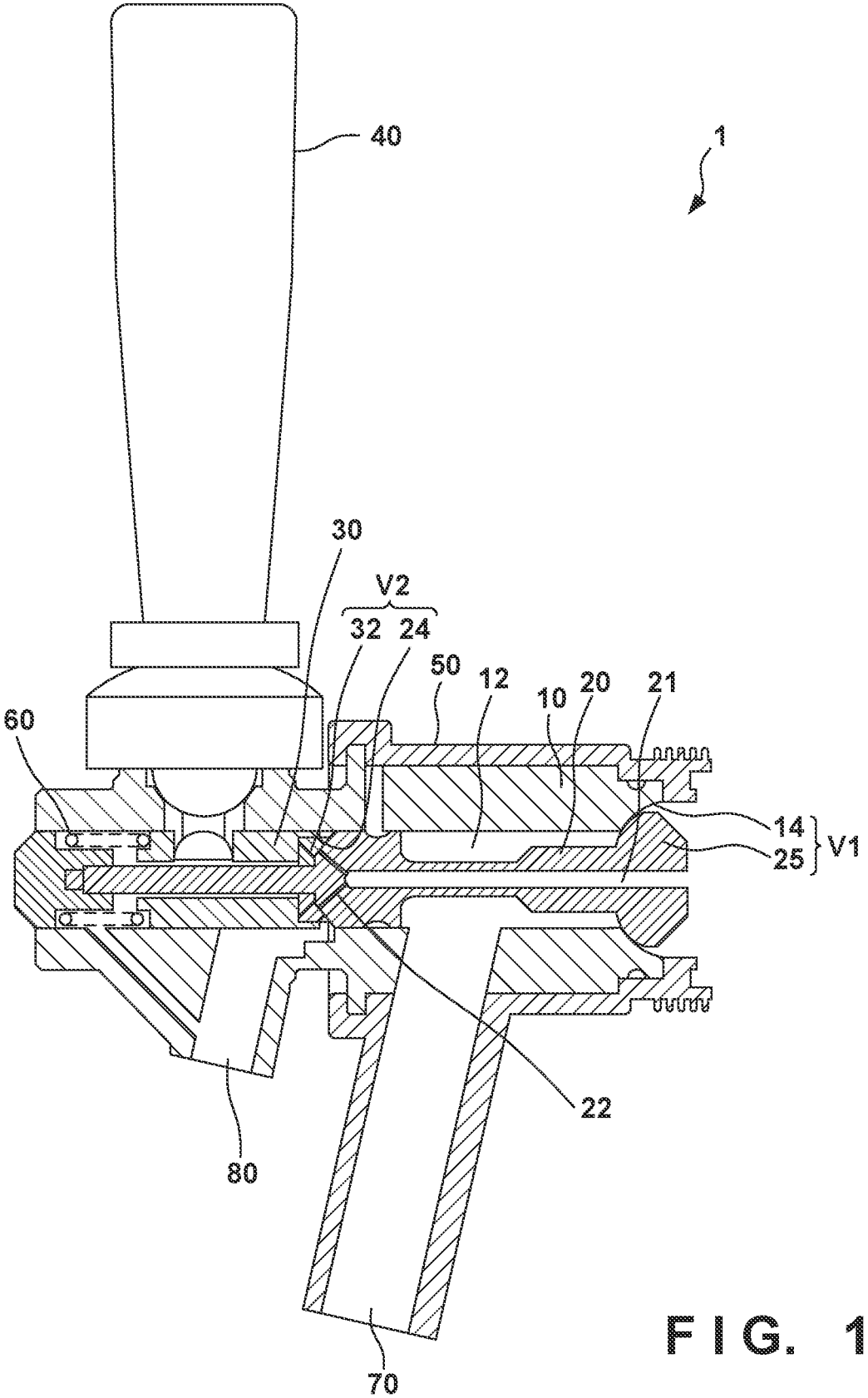
FIG. 1 is a view showing the arrangement (in a standby state) of a beverage discharge cock.
Figure 2:
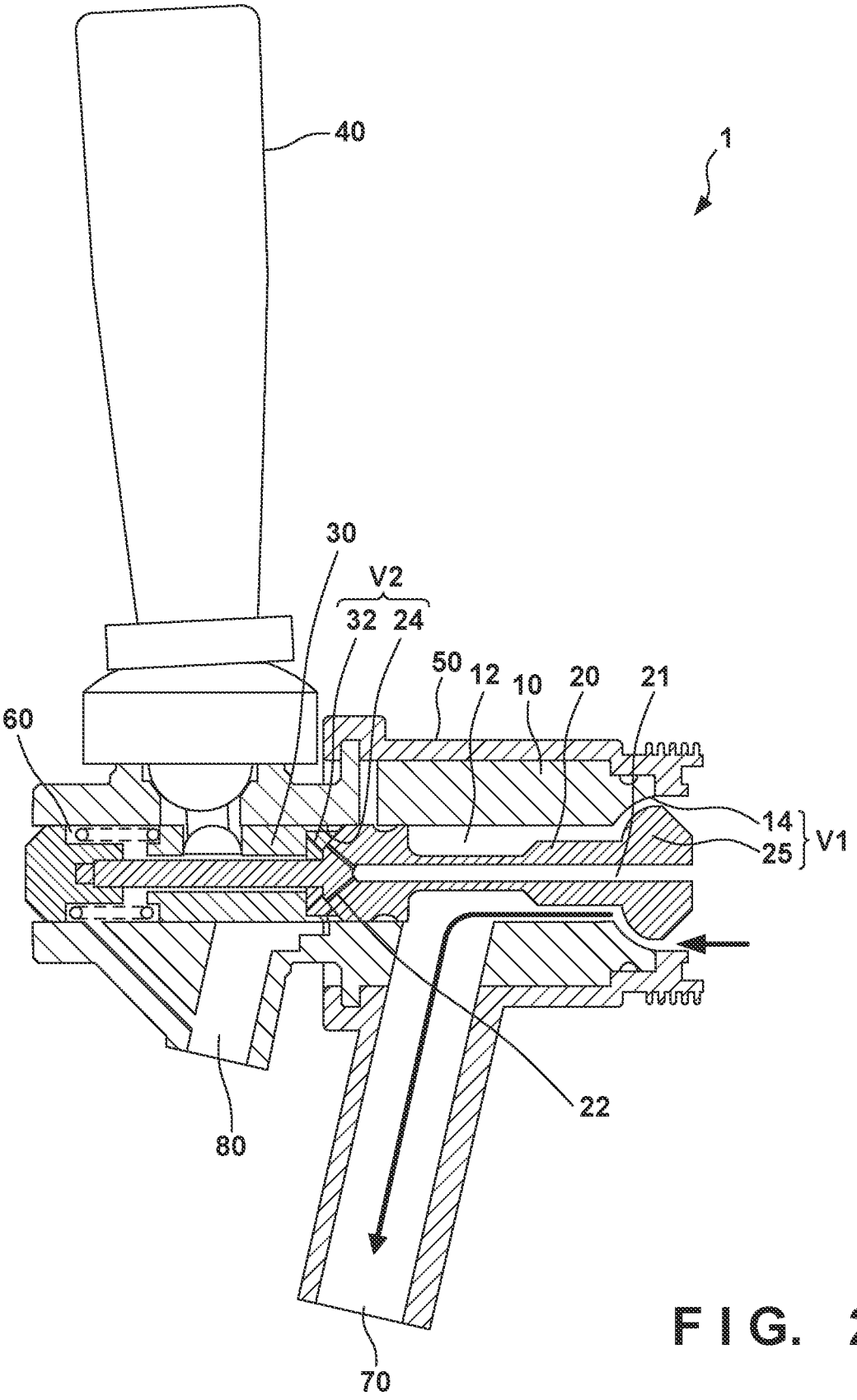
FIG. 2 is a view showing the arrangement (in a discharge state) of the beverage discharge cock.
Figure 3:
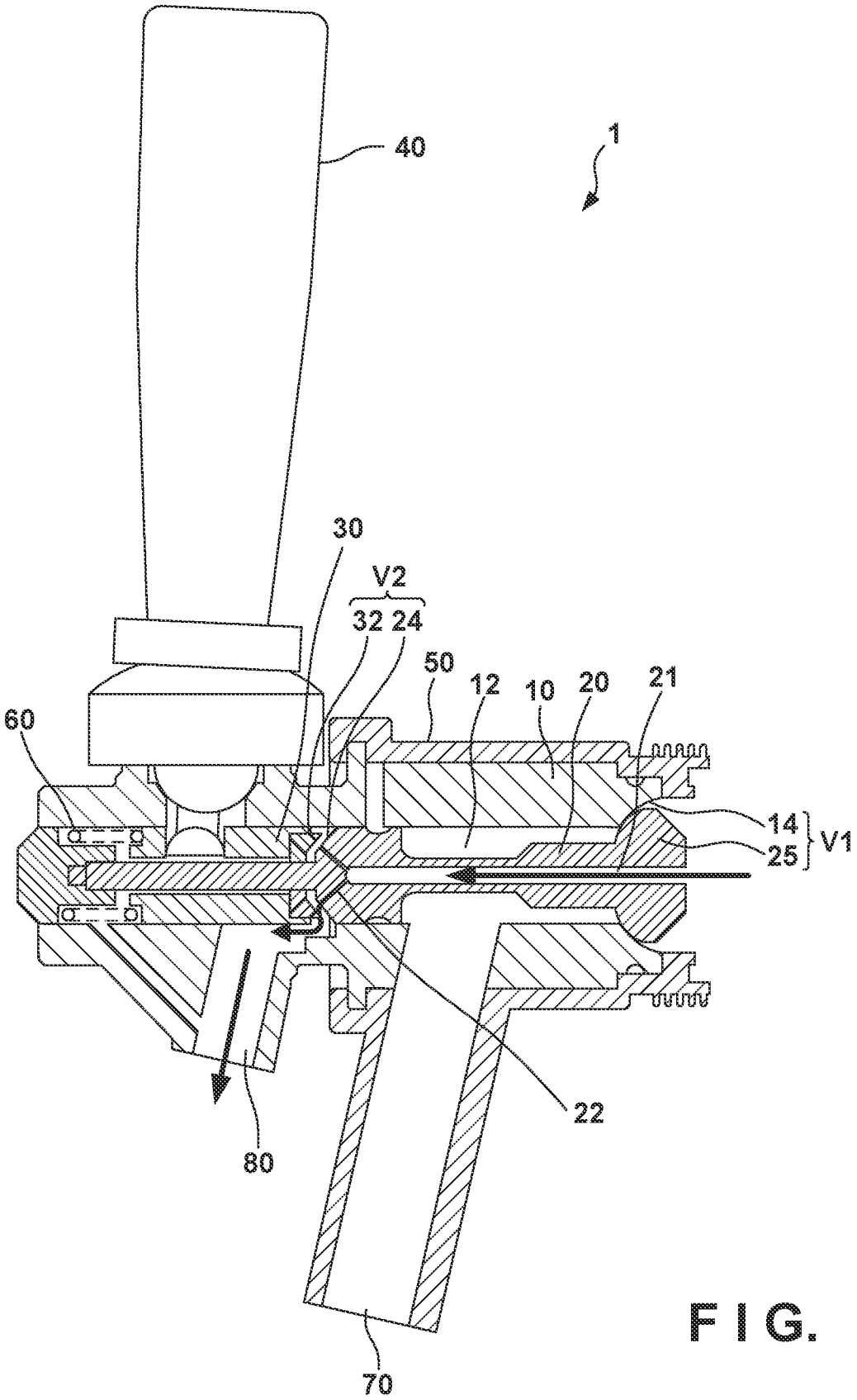
FIG. 3 is a view showing the arrangement (in a foaming state) of the beverage discharge cock.

FIGS. 1 to 3 show the beverage discharge cock 1. FIG. 1 shows a standby state, FIG. 2 shows a discharge state, and FIG. 3 shows a foaming state. The beverage discharge cock 1 includes a housing 50 to be attached to the main body of the beverage dispenser 101, a valve main body 10, a valve rod 20, a movable part 30, a lever 40, and a spring 60.

The valve main body 10 includes a hole 12, and a valve seat 14 arranged in the end portion of the hole 12. The valve main body 10 also includes a foaming hole 80 for discharging foam of a beverage. The valve main body 10 may also be formed as a part integrated with the housing 50. The valve rod 20 is slidably arranged in the hole 12 of the valve main body 10. The valve rod 20 includes a valve body 25 that forms a first valve V1 together with the valve seat 14 of the valve main body 10, and a first seal 24. The first valve V1 is a valve for controlling the discharge of a beverage such as beer. The movable part 30 is slidably arranged in the hole 12 of the valve main body 10. The movable part 30 has a second seal 32 facing the first seal 24 of the valve rod 20. The second seal 32 forms a second valve V2 together with the first seal 24 of the valve rod 20. The second valve V2 is a valve for controlling the supply (foaming) of foam of a beverage. The valve rod 20 includes a first channel 21 extending through the valve body 25, and one or a plurality of second channels 22 extending from the first seal 24 to the first channel 21. The housing 50 includes a discharge hole 70 for discharging a beverage. In the standby state as shown in FIG. 1, the first seal 24 of the valve rod 20 and the second seal 32 of the movable part 30 are in contact with each other. Also, in the standby state, the valve body 25 of the valve rod 20 is in contact with the valve seat 14 of the valve main body 10.

When discharging a beverage as shown in FIG. 2, the lever 40 is pivoted counterclockwise in FIG. 2, so the movable part 30 moves to the right in FIG. 2. Since the second seal 32 of the movable part 30 and the first seal 24 of the valve rod 20 are in contact with each other, when the movable part 30 moves to the right in FIG. 2, the valve rod 20 also moves to the right accordingly. This forms a gap (channel) between the valve seat 14 of the valve main body 10 and the valve body 25 of the valve rod 20, and a beverage supplied from the main body of the beverage dispenser 101 is supplied to the discharge hole 70 through the gap between the valve seat 14 and the valve body 25, and discharged through the discharge hole 70.

When foaming the beverage as shown in FIG. 3, the lever 40 is pivoted clockwise in FIG. 3, so the movable part 30 moves to the left in FIG. 3 while compressing the spring 60. When the movable part 30 moves to the left, a gap (channel) is formed between the first seal 24 of the valve rod 20 and the second seal 32 of the movable part 30, so the beverage supplied from the main body of the beverage dispenser 101 is supplied to the gap between the first seal 24 and the second seal 32 through the first channel 21 and the second channel 22 of the valve rod 20. In this state, the beverage is foamed. The foamed beverage is pushed out through the foaming hole 80.

Figure 4:
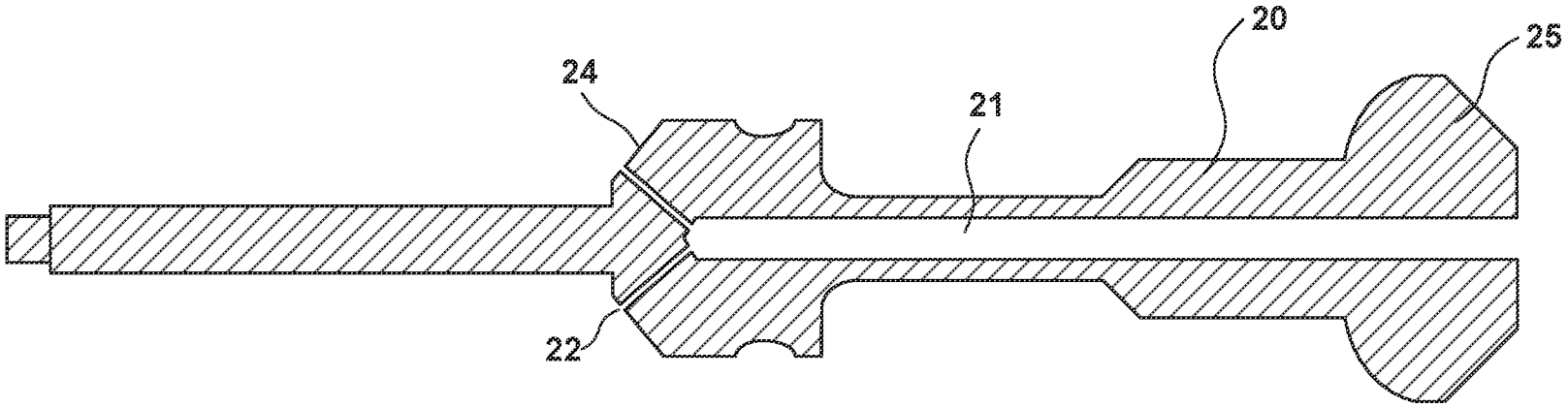
FIG. 4 is a view showing the arrangement of a valve rod to be incorporated into the beverage discharge cock.
Figure 5:
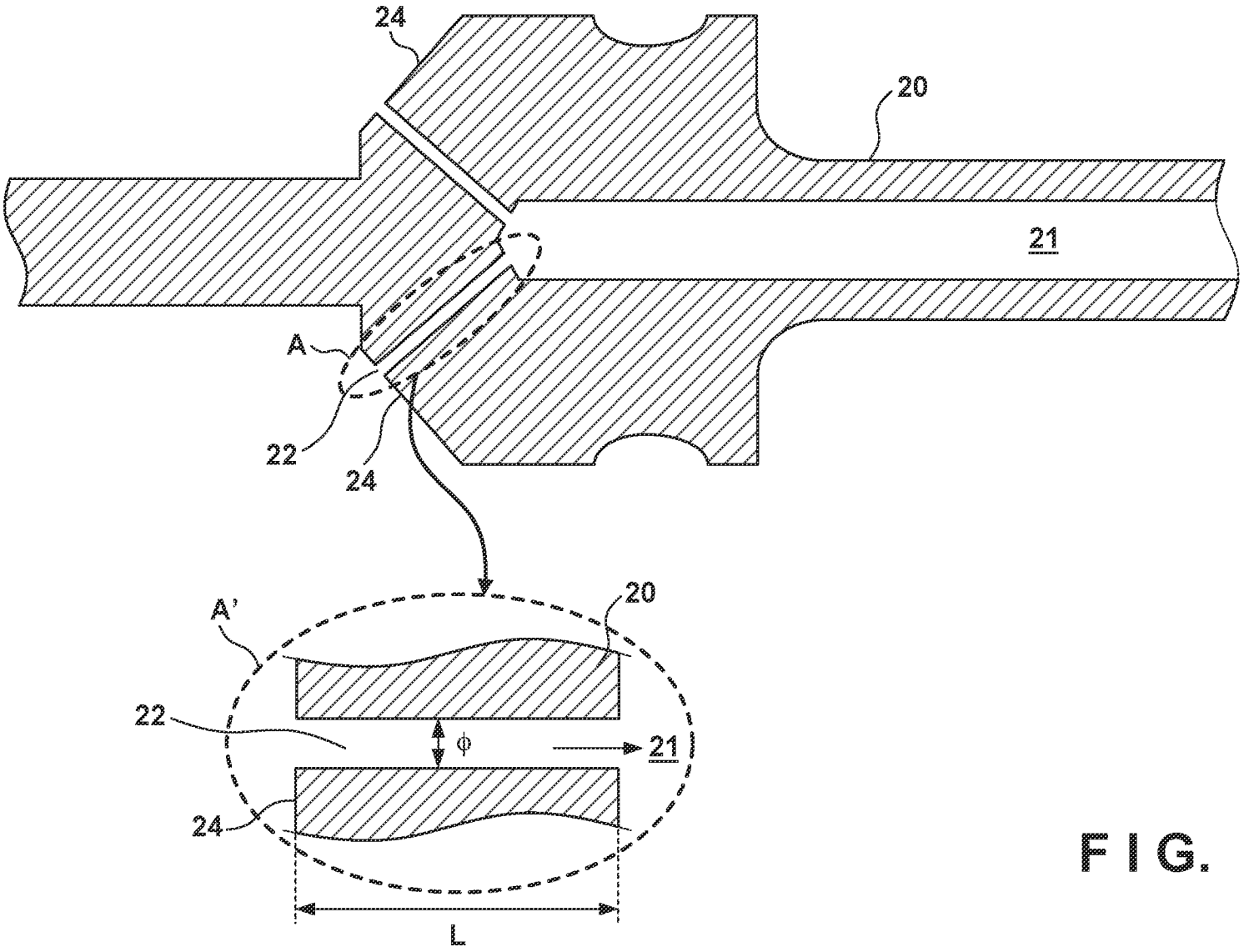
FIG. 5 is a view showing a second channel of a comparative example.
Figure 6:
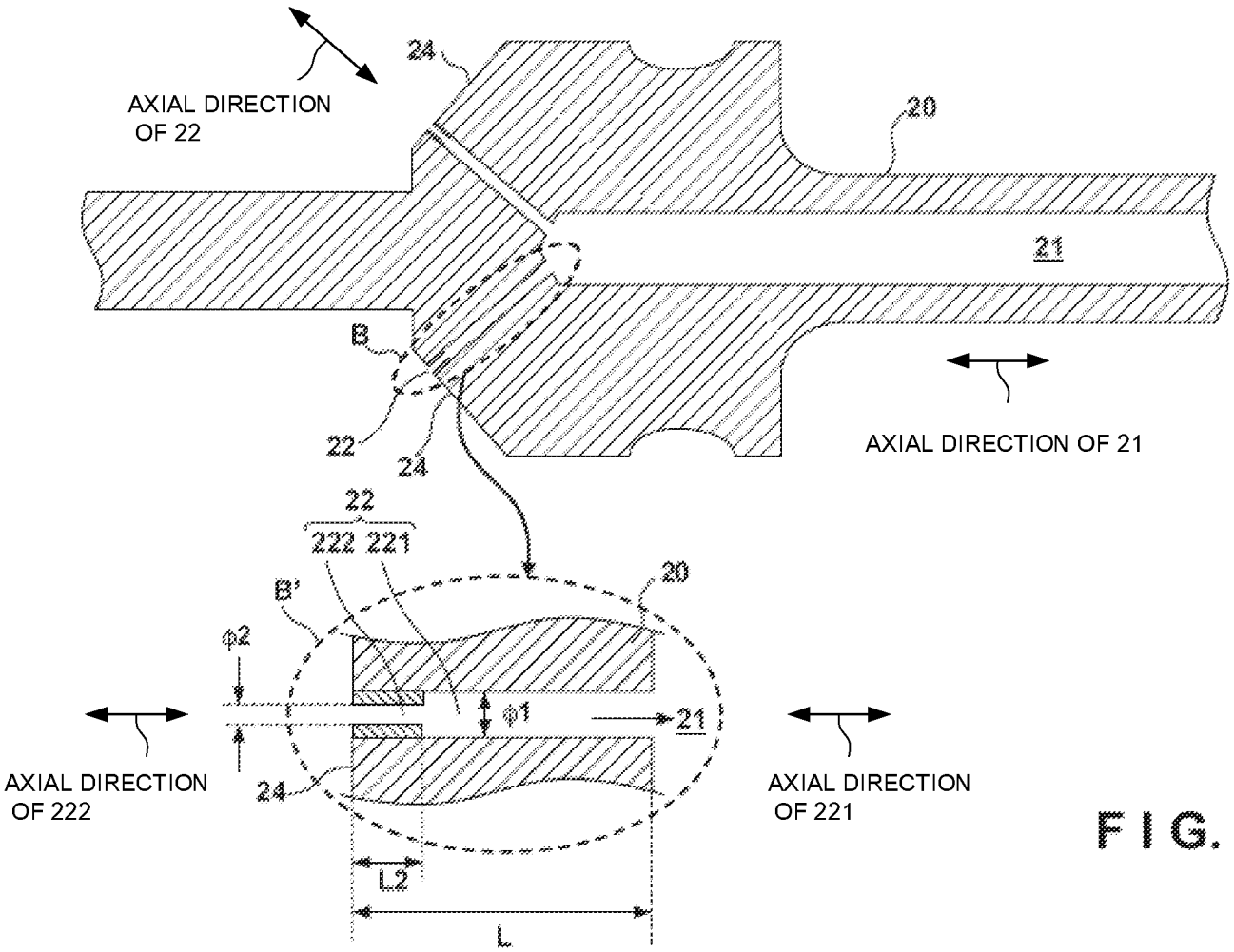
FIG. 6 is a view showing a second channel of an embodiment.

FIG. 4 shows the valve rod 20 in an enlarged scale. The beverage discharge cock 1 or the valve rod 20 of this embodiment has a feature in the structure of the second channel 22. FIG. 5 shows a comparative example of the second channel 22. A portion indicated by A' shows a portion indicated by A in an enlarged scale. FIG. 6 shows the second channel 22 in the beverage discharge cock 1 or the valve rod 20 of this embodiment. A portion indicated by B' shows a portion indicated by B in an enlarged scale.

In the comparative example shown in FIG. 5, the second channel 22 has a predetermined diameter $\phi$. On the other hand, the second channel 22 of this embodiment includes a first portion 221, and a second portion 222 arranged between the first seal 24 and the first portion 221. A diameter $\phi 2$ of the second portion 222 is smaller than a diameter $\phi 1$ of the first portion 221. The second portion 222 functions as an orifice for decreasing the diameter of the second channel 22. That is, the second channel 22 of this embodiment has an orifice. By forming the orifice in the second channel 22, the flow rate of a beverage increases in the orifice (second portion 222), and fine foam is efficiently formed when this beverage is pushed out into the gap between the first seal 24 and the second seal 32. It is also possible to suppress a decrease in flow rate of the beverage by forming the first portion 221 having a diameter larger than that of the second portion 222.

By forming the orifice in the second channel 22, it is possible to form fine creamy foam compared to the comparative example as will be described later. The number of the second channels 22 is preferably 1, 2, 3, or 4, but is not limited to these numbers. The axial direction of the second channel 22 is typically a direction intersecting the axial direction of the first channel 21.

FIG. 7 shows the effects of the formation of the orifice (second portion 221) in the second channel 22. "FOAM DENSITY RATIO" shown in FIG. 7 is an index indicating the effect of the formation of the orifice (second portion 221) in the second channel 22, and represents the foam density of each sample according to this embodiment by % when the foam density of the comparative example is 100%. Note that the experiment was conducted over a plurality of days, so the foam density of the comparative example was measured on each experimental day, and the foam density ratio of each sample according to this embodiment was calculated by assuming that the foam density of the comparative example was 100%.

The foam density was evaluated by imaging foam collected by a vessel by using a microscope, cutting out a 1-mm square region from the obtained image, and counting bubbles in the region. It is possible to regard that a higher foam density means finer creamier foam. Evaluation by the foam density is excellent as objective evaluation. In the comparative example, a length L (in the axial direction) of the second channel 22=6.25 mm, a diameter ϕ of the second channel 22=1.0 mm, and the number of the second channels=1.

In this embodiment, a length L2 (in the axial direction) of the second portion of the second channel 22=0.5 to 2.5 mm, and the length L of the second channel 22, which is the sum of the length of the second portion 222 and the length of the first portion 221=6.25 mm. Also, in this embodiment, the diameter ϕ2 of the second portion 222 (the orifice) was 0.5 to 0.8 mm, and the diameter ϕ1 of the first portion 221 was 2.0 mm. In addition, the number of the second channels 22 was 1 to 4 in this embodiment. All the effects shown in FIG. 7 exceed 100%, that is, foam densities higher than that of the comparative example were obtained.

Note that although not shown in FIG. 7, the foam density is insensitive to the diameter ϕ1 of the first portion 221 at least when the diameter ϕ1 of the first portion 221 falls within the range from 1.5 to 2.5 mm. It is estimated that good results are obtained even when the diameter ϕ1 of the first portion 221 falls outside the range from 1.5 to 2.5 mm. Note also that although not shown in FIG. 7, the foam density is insensitive to the length L of the second channel 22 at least when the length L of the second channel 22 falls within the range from 5 to 8 mm. It is estimated that good results are obtained even when the length L of the second channel 22 falls outside the range from 5 to 8 mm.

From the results shown in FIG. 7, the length L2 of the second portion 222 is preferably within a range from 0.5 to 2.5 mm. The diameter ϕ2 of the second portion 222 is preferably within a range from 0.5 to 0.8 mm, and more preferably 0.6 to 0.8 mm. The number of the second channels 22 (second portions 222) is preferably 1, 2, 3, or 4. It is favorable that the number of the second channels 22 (second portions 222) is 2, the length L2 of the second portion is within a range from 0.5 to 2.5 mm, and the diameter ϕ2 of the second portion 222 is within a range from 0.6 to 0.8 mm.

The axial direction of the second channel 22 is typically a direction intersecting the axial direction of the first channel 21, and the angle at which the axial direction of the second channel 22 intersects the axial direction of the first channel 21 is preferably within a range from 20° to 60°. The axial direction of the second portion 222 is preferably equal to the axial direction of the first portion 221.

REFERENCE SIGNS LIST

1: beverage discharge cock, 10: valve main body, 12: hole, 14: valve seat, 20: valve rod, 21: first channel, 22: second channel, 24: first seal, 25: valve body, 30: movable part, 32: second seal, 40: lever, 50: housing, 60: spring, 70: discharge hole, 80: foaming hole, 100: beverage discharge apparatus, V1: first valve, V2: second valve, 221: first portion, 222: second portion

The invention claimed is:

1. A beverage discharge cock to which beverage is supplied from a beverage supply source, comprising:

a valve main body including a hole and a valve seat arranged in an end portion of the hole;

a valve rod slidably arranged in the hole, and including a valve body that forms a first valve together with the valve seat of the valve main body, and a first seal; and a movable part slidably arranged in the hole, and including a second seal facing the first seal, the second seal forming a second valve together with the first seal of the valve rod, wherein the valve rod includes a first channel extending through the valve body, and one or a plurality of second channels extending from the first seal to the first channel, an axial direction of the second channel is an inclined direction intersecting an axial direction of the first channel, and the second channel includes a first portion, and a second portion arranged between the first seal and the first portion, and a diameter of the second portion is smaller than a diameter of the first portion.

2. The beverage discharge cock according to claim 1, wherein a length of the second portion is within a range from 0.5 to 2.5 mm.

3. The beverage discharge cock according to claim 1, wherein a diameter of the second portion is within a range from 0.5 to 0.8 mm.

4. The beverage discharge cock according to claim 1, wherein the diameter of the second portion is within a range from 0.6 to 0.8 mm.

5. The beverage discharge cock according to claim 1, wherein the number of the second channels is one of 1, 2, 3, and 4.

6. The beverage discharge cock according to claim 1, wherein the number of the second channels is 2, a length of the second portion is within a range from 0.5 to 2.5 mm, and a diameter of the second portion is within a range from 0.6 to 0.8 mm.

7. The beverage discharge cock according to claim 1, wherein a length of the second channel is within a range from 5 to 8 mm.

8. The beverage discharge cock according to claim 1, wherein a diameter of the first portion is within a range from 1.5 to 2.5 mm.

9. The beverage discharge cock according to claim 1, wherein the first seal includes an inclined surface which is inclined with respect to the axial direction of the first channel, the second channel extends from the inclined surface to the first channel; and the valve rod includes a portion extending from a center of the first seal in a direction opposite to the value body and in the axial direction of the first channel.

10. The beverage discharge cock according to claim 9, wherein an angle at which the axial direction of the second channel intersects the axial direction of the first channel is within a range from 20° to 60°.

11. The beverage discharge cock according to claim 1, wherein an axial direction of the second portion is equal to an axial direction of the first portion.

12. A valve rod to be incorporated into a beverage discharge cock to which beverage is supplied from a beverage supply source, wherein the valve rod includes a valve body and a seal, the valve rod includes a first channel extending through the valve body, and one or a plurality of second channels extending from the seal to the first channel, an axial direction of the second channel is an inclined direction intersecting an axial direction of the first channel, and the second channel includes a first portion, and a second portion arranged between the seal and the first portion, and a diameter of the second portion is smaller than a diameter of the first portion.

13. The valve rod according to claim 12, wherein a length of the second portion is within a range from 0.5 to 2.5 mm.

14. The valve rod according to claim 12, wherein a diameter of the second portion is within a range from 0.5 to 0.8 mm.

15. The valve rod according to claim 12, wherein the diameter of the second portion is within a range from 0.6 to 0.8 mm.

16. The valve rod according to claim 12, wherein the number of the second channels is one of 1, 2, 3, and 4.

17. The valve rod according to claim 12, wherein the number of the second channels is 2, a length of the second portion is within a range from 0.5 to 2.5 mm, and a diameter of the second portion is within a range from 0.6 to 0.8 mm.

18. The valve rod according to claim 12, wherein a length of the second channel is within a range from 5 to 8 mm.

19. The valve rod according to claim 12, wherein a diameter of the first portion is within a range from 1.5 to 2.5 mm.

20. The valve rod according to claim 12, wherein the first seal includes an inclined surface which is inclined with respect to the axial direction of the first channel, the second channel extends from the inclined surface to the first channel, and the valve rod includes a portion extending from a center of the first seal in a direction opposite to the valve body and in the axial direction of the first channel.

21. The valve rod according to claim 20, wherein an angle at which the axial direction of the second channel intersects the axial direction of the first channel is within a range from 20° to 60°.

22. The valve rod according to claim 12, wherein an axial direction of the second portion is equal to an axial direction of the first portion.

23. A beverage dispenser comprising a beverage discharge cock as defined in claim 1.

* * * * *